United States Patent [19]

Smith

[11] 4,409,067

[45] Oct. 11, 1983

[54] QUENCHING METHOD AND APPARATUS

[75] Inventor: Jimmy B. Smith, Columbia, Tenn.

[73] Assignee: Peabody Coal Company, St. Louis, Mo.

[21] Appl. No.: 374,944

[22] Filed: May 5, 1982

[51] Int. Cl.[3] ..... C10B 39/04; C10B 45/00

[52] U.S. Cl. ..... 201/1; 201/39; 202/227

[58] Field of Search ..... 201/1, 39; 202/95, 227, 202/228, 253, 270; 432/85

[56] References Cited

U.S. PATENT DOCUMENTS

| | | | |
|---|---|---|---|
| 1,840,403 | 1/1932 | Loebell | 201/39 |
| 3,331,754 | 7/1967 | Mansfield | 201/39 |
| 3,959,083 | 5/1976 | Goedde et al. | 201/39 |
| 3,988,211 | 10/1976 | Lewandowski et al. | 201/39 |
| 4,066,513 | 1/1978 | Jablin | 202/227 |
| 4,092,222 | 5/1978 | Kataoka et al. | 202/227 |
| 4,100,034 | 7/1978 | Smith et al. | 201/39 |
| 4,282,068 | 8/1981 | Flockenhaus et al. | 202/227 |
| 4,288,294 | 9/1981 | Velling | 202/227 |
| 4,344,823 | 8/1982 | Stratmann et al. | 202/228 |
| 4,358,343 | 11/1982 | Goedde et al. | 201/39 |

FOREIGN PATENT DOCUMENTS

| | | | |
|---|---|---|---|
| 2023253 | 11/1971 | Fed. Rep. of Germany | 202/227 |
| 2900079 | 7/1980 | Fed. Rep. of Germany | 202/227 |

*Primary Examiner*—Bradley Garris

*Attorney, Agent, or Firm*—Littlepage & Webner

[57] ABSTRACT

A column of hot coke from a shaft furnace moves downwardly into a vessel which it fills and forms a pile. A gap is left between the angle of repose of the coke surface and the upper portion of the vessel. Water is sprayed onto hot coke as it enters the vessel. The gap is vented to an exhaust duct. A baffle near the center of the vessel deflects the material to the sides and creates a void in the center of the vessel, which void is also vented to the exhaust duct. More water is sprayed on the coke adjacent the void. Steam pressure in the vessel is reduced by a fan which pulls steam through the exhaust ducts. The steam pressure is regulated by a pressure controller which modulates a damper in the exhaust duct. A temperature controller regulates the flow of quench water to the vessel. This regulates the temperature and moisture content of the material being cooled.

5 Claims, 1 Drawing Figure

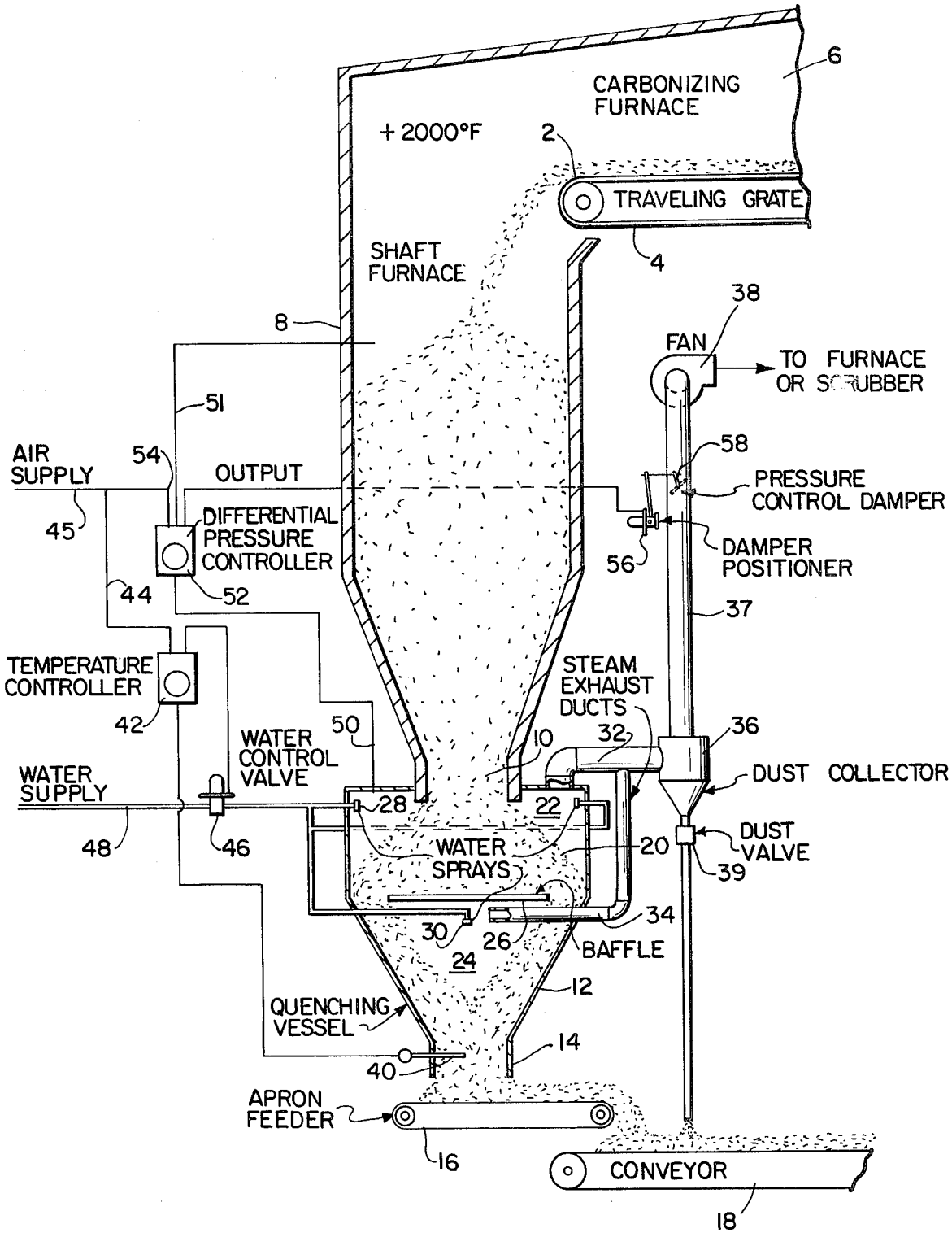
CARBONIZING FURNACE
6
+2000°F
2
TRAVELING GRATE
4
SHAFT FURNACE
38
FAN
TO FURNACE OR SCRUBBER
8
51
58
AIR SUPPLY
54
OUTPUT
PRESSURE CONTROL DAMPER
45
DIFFERENTIAL PRESSURE CONTROLLER
56
DAMPER POSITIONER
44
52
37
TEMPERATURE CONTROLLER
STEAM EXHAUST DUCTS
42
50
36
WATER CONTROL VALVE
10
32
DUST COLLECTOR
WATER SUPPLY
28
22
48
46
WATER SPRAYS
20
DUST VALVE
39
34
30
26
BAFFLE
24
12
QUENCHING VESSEL
14
40
APRON FEEDER
16
CONVEYOR
18

QUENCHING METHOD AND APPARATUS

PRIOR ART

U.S. Pat. Nos. to Lewandowski, et al., 3,988,211 and Smith & Haley 4,100,034.

BACKGROUND AND OBJECTS

In the operation of the apparatus of the Smith & Haley U.S. Pat. No. 4,100,034, if excess pressure builds up in the quenching chamber, material may be blown through the material outlet thereby causing contamination and destabilization of the operation. Also, if excess pressures prevail in the quenching vessel, steam enters the shaft furnace through the material discharging therefrom, thereby undesirably cooling material in the shaft furnace and further destabilizing the operation. Reduction of contacting water in the material in the quench vessel in order to reduce the pressures therein undesireably reduces the cooling of the material. Comparable problems may arise in the operation of the Lewandowski, et al. (supra) apparatus.

The object now is to provide a quenching vessel and method wherein the build-up of excessive pressures within the quench vessel are avoided while still maintaining the desired contact of cooling water.

In accordance with the above-objectives, it is now intended to create two voids, one being a gap in the upper portion of the quench chamber above the angle of repose of the surface of the hot material in the upper portion thereof, and a lower one in the down flowing material centrally of the quench chamber, the cooling water being sprayed onto the hot material surfaces at both voids and the resultant steam being withdrawn directly from both voids without raising the pressure of the steam within the hot material itself.

In addition, it is intended now to provide for total control of the quenching process, controlled by the sensed temperature of the quenched material about to leave the quenching vessel, and the pressure in the gap above the hot material in the upper portion of the quenching vessel, which sensed temperatures and pressures control the amount of waters sprayed into the voids and upon the hot material at the voids, and to control the steam pressure prevailing in both voids.

These and other objects will be apparent from the sole drawing FIGURE which is a diagrammatic cross-section of the apparatus and the controls relating to the quenching process.

Referring now to the drawing, in which the sole FIGURE is a diagram of the apparatus, hot incandescent coke 2 dropping off the end of a traveling chain grate 4 in a carbonizing furnace 6 falls into a shaft furnace 8 which functions as a soaking pit. The operations of the carbonizing furnace 6 and shaft furnace 8 are well-known. In general, most of the residual volatiles remaining in the hot coke after the latter has passed through the carbonizing furnace are driven therefrom in the shaft furnace as the hot coke works its way down through the shaft furnace and exits via a throat 10 at the bottom of the shaft furnace. It is essential that coke be quenched before it is exposed to the atmosphere, lest it ignite spontaneously. Quenching is performed in a quenching vessel 12 through which it moves downwardly from throat 10 of shaft furnace 8, the quenched coke exiting via a bottom outlet 14 onto an apron feeder 16 and thence onto a conveyor 18.

As the hot coke moves downwardly into quenching vessel 12, its upper surface forms an angle of repose 20, and between the angle of repose and the upper portion of quenching vessel 12 is a gap 22. A void 24 in the hot coke is formed by a baffle 26, the void 24 being completely surrounded by the downwardly moving coke which is being quenched. The baffle spreads the hot material to the sides so that it will mix with the material that has been sprayed. Water is sprayed into the gap 22 and onto the repose surface 20 by nozzles 28, and water is sprayed into void 24 by nozzles 30. Steam is exhausted from both the gap and void 22 and 24 via steam exhaust ducts 32 and 34 which lead from the gap and void through a dust collector 36, from which they are drawn through an exhaust pipe 37 as by fan 38. Dust from collector 36 is disposed of through a dust valve 39 and thence onto conveyor 18.

Near the exit end of throat 14 is a temperature sensor 40 which senses the temperature of the coke moving through throat 14 onto apron feeder 16, the signal from temperature sensor 40 being transmitted to a temperature controller 42 in a branch 44 of air supply line 45, the temperature controller 42 in turn operating the water control valve 46 in the water supply line 48 leading to nozzles 28 and 30. Pressure sample lines 50 and 51 lead from gap 22 and to the interior of shaft furnace 8 to a differential pressure controller 52 in the air supply branch 54 which leads to a pneumatic damper positioner 56 for the pressure controlled damper 58 in the steam exhaust pipe 37. The differential pressure controller 52 not only assures that the pressure in the quench vessel will never be great enough to blow material from the outlet 14, but also that the pressure in the quench vessel will be maintained slightly less than in the shaft furnace.

In operation, the steam pressures in gap 22 and void 24 are maintained at no more than atmospheric pressure by pressure control damper 58 so that the steam in the quenching vessel cannot blow the quenched coke out through the outlet 14 in the bottom of the vessel, nor can it move upwardly through the throat 10 in the bottom of shaft furnace 8. When the temperature sensed by temperature sensor 40 calls for more quenching, water control valve 46 is opened sufficiently to increase the water supply via nozzles 28 and 30 into the gap and void and onto the adjacent hot coke; and rise in pressure in gap 22 and void 24 (they being joined by steam exhaust ducts 32 and 34) causes pressure controller 52 to actuate damper positioner 56 so that damper 58 is opened, whereby fan 38 maintains the pressure within quenching vessel 12 at the desired levels described above.

As is well-known in this art, the height of the stack in the quenching vessel is maintained by the rate of discharge via the apron feeder such as to maintain a gap between the top of the stack and the top of the quenching vessel. While the invention has been described as for quenching coke, it is equally useable for quenching char and other hot particulate material.

I claim:

1. A method for quenching hot particulate char material, which comprises;

gravity feeding said material from a shaft furnace through a confined space from the top thereof while discharging the material from the bottom of said space at a rate such as to maintain a downwardly moving stack in the space with a gap between the top of the stack of said material and the top of the space, forming a void in the stack intermediate the top and bottom thereof, which void is at least partly defined by said material, spraying water at a controlled rate onto material at the top of the stack and onto the material defining said void, withdrawing steam at a controlled rate from the gap and the void, sensing the temperature of the material discharging from the bottom of the stack, sensing the pressure prevailing in the shaft furnace, sensing the pressure of steam in the gap, controlling the rate of water sprayed in accordance with the sensed temperature of the discharging material such as to maintain said temperature below a predetermined maximum and controlling the rate of withdrawal of steam from the gap and void in accordance with the sensed pressure in the gap such as to maintain the steam pressure therein below a predetermined maximum and below the pressure prevailing in the shaft furnace.

2. The method recited in claim 1 wherein steam pressures in the gap and void are maintained the same.

3. The method recited in claim 2, wherein the steam is withdrawn from the gap and void into a common outlet.

4. In a coke quenching vessel which receives hot coke from a shaft furnace and through which the hot coke moves downwardly and out through an exit in the lower end thereof and wherein the upper surface of the downwardly moving coke in the quenching vessel lies at an angle of repose which leaves a gap thereabove in the upper end of the quenching vessel, the improvement which comprises;

means for forming a void in the downwardly moving coke comprising baffle means extending partly across the middle of such quenching vessel generally intermediately between the upper and lower ends thereof, means for spraying water into the gap and void and onto the surfaces of the coke adjacent thereto, steam exhaust ducts leading from both the gap and void, means for sensing the temperature of the coke exiting the quenching vessel, means for sensing the steam pressure in the gap, means for sensing the pressure prevailing in the shaft furnace, means for controlling the supply of water to the spraying means in accordance with the sensed temperature of the exiting coke, and means for controlling the steam pressure in the gap and void below the sensed pressure prevailing in the shaft furnace.

5. The combination claimed in claim 4, wherein said steam exhaust ducts are connected to a common outlet pipe, the means for controlling the steam pressure in the gap and void comprises an exhaust fan in the common outlet pipe, a damper in said pipe, and a damper actuator controlled by the differential between sensed pressures in the gap and shaft furnace.

* * * * *

UNITED STATES PATENT AND TRADEMARK OFFICE

CERTIFICATE OF CORRECTION

PATENT NO. : 4,409,067

DATED : October 11, 1983

INVENTOR(S) : Jimmy B. Smith

It is certified that error appears in the above-identified patent and that said Letters Patent is hereby corrected as shown below:

On the title page:

Assignee:

Delete "Peabody Coal Company"
Insert --Peabody Development Company--

Signed and Sealed this

Sixth Day of March 1984

[SEAL]

*Attest:*

GERALD J. MOSSINGHOFF

*Attesting Officer*

*Commissioner of Patents and Trademarks*